US005126095A

United States Patent [19]

Crosno et al.

[11] Patent Number: 5,126,095

[45] Date of Patent: Jun. 30, 1992

[54] METHOD FOR ENCASING A STORAGE TANK IN CONCRETE

[75] Inventors: Ray E. Crosno, San Luis Obispo; Harvey E. Petersen, Morro Bay; Leslie D. Scott, Atascadero, all of Calif.

[73] Assignee: Trusco Tank, Inc., San Luis Obispo, Calif.

[21] Appl. No.: 734,909

[22] Filed: Jul. 24, 1991

[51] Int. Cl.[5] ..... B28B 1/16; B28B 7/16; B28B 7/38; B28B 13/06

[52] U.S. Cl. ..... 264/515; 249/91; 249/94; 249/96; 249/97; 249/142; 249/160; 249/162; 249/172; 264/572; 264/219; 264/229; 264/250; 264/254; 264/256; 264/261; 264/263; 264/273; 264/275; 264/277; 264/278; 264/279; 264/279.1; 264/308; 264/333; 264/334; 264/338

[58] Field of Search ..... 264/510, 512, 516, 572, 264/573, 574, 228, 229, 256, 308, 275, 278, 279, 279.1, 334, 338, 31-35, 36, 219, 333, 133, 254, 261, 263, 273, 277, 130, 264, 250; 249/91, 94, 96, 97, 142, 162, 160, 170-172; 29/421.1; 52/743, 741, 128, 135, 515, 249, 269, 268, 169.6-169.8

[56] References Cited

U.S. PATENT DOCUMENTS

| | | | |
|---|---|---|---|
| 633,804 | 9/1899 | Chamberlain . | |
| 1,153,535 | 9/1915 | Babich . | |
| 1,180,367 | 4/1916 | Babich . | |
| 1,185,614 | 6/1916 | Babich . | |
| 1,267,495 | 5/1918 | Babich . | |
| 1,355,122 | 10/1920 | Birtliff | 264/34 |
| 1,950,778 | 3/1934 | Boehmig | 264/35 |
| 1,957,027 | 5/1934 | Lasley | 264/256 |
| 2,903,877 | 9/1959 | Meade | 264/35 |
| 3,471,599 | 10/1969 | Archer . | |
| 3,514,913 | 6/1970 | Nelson . | |
| 3,542,914 | 11/1970 | Vergne, Jr. | 264/333 X |
| 3,793,428 | 2/1974 | Gordon | 264/263 X |
| 4,023,257 | 5/1977 | Wright et al. | 264/275 X |
| 4,183,221 | 1/1980 | Yamamoto . | |
| 4,214,670 | 7/1980 | Berger et al. | 264/275 X |
| 4,224,265 | 9/1980 | Pfisterer . | |
| 4,372,906 | 2/1983 | del Valle . | |
| 4,604,250 | 8/1986 | Ecker | 264/275 X |
| 4,653,718 | 3/1987 | Dickens | 264/275 X |
| 4,737,333 | 4/1988 | Matthynssens | 264/275 X |
| 4,770,317 | 9/1988 | Podgers et al. . | |
| 4,790,508 | 12/1988 | Henderson et al. | 249/172 X |
| 4,807,675 | 2/1989 | Sharp . | |
| 4,808,356 | 1/1989 | West et al. | 264/278 X |
| 4,826,644 | 5/1989 | Linquist et al. | 264/34 X |
| 4,934,122 | 6/1990 | Linquist | 264/275 X |
| 4,986,436 | 1/1991 | Bambacigno et al. . | |

OTHER PUBLICATIONS

Basic Technology, Inc., "Design Report of USERSA Double-Walled Waste Storage Tanks for Tank Farm No. 241-AW at Hanford Works", Basic Technology, Inc. Report, Feb. 25, 1977, pp. 45-49.

Takehiko Murano, "Fuel Storage Tank Interior Coating", Maeda Construction Co., Ltd. Report, Aug. 27, 1984.

*Primary Examiner*—Karen Aftergut

*Attorney, Agent, or Firm*—Blakely, Sokoloff, Taylor & Zafman

[57] ABSTRACT

A method and apparatus for constructing an above ground concrete encased storage tank. The apparatus has a support assembly that extends from the baseplate of a concrete form, that supports, elevates, and secures an inner storage tank from the form baseplate, so that the tank may be completely surrounded by concrete. The form has removable walls that may be pivotally attached to the baseplate and initially in a horizontal position. The support assembly has anchor bolts that extend through holes in the baseplate. The anchor bolts are screwed into anchor nuts that are attached to a pair of brackets. The anchor nuts and brackets are spaced from the baseplate by sleeves that fit over the threaded portions of the anchor bolts. The brackets are constructed to support the storage tank, which is placed in the form on top of the support assembly. The tank is then fastened to the support assembly. After the tank is secured, the walls of the form are placed into a vertical position to create an enclosure with an opening at the top. Concrete is then poured into the form until the tank is completely surrounded by concrete. The concrete is allowed to set and the anchor bolts, sleeves and form are removed from the concrete. The holes created therein are patched with concrete, wherein there is constructed an above ground storage vault.

41 Claims, 5 Drawing Sheets

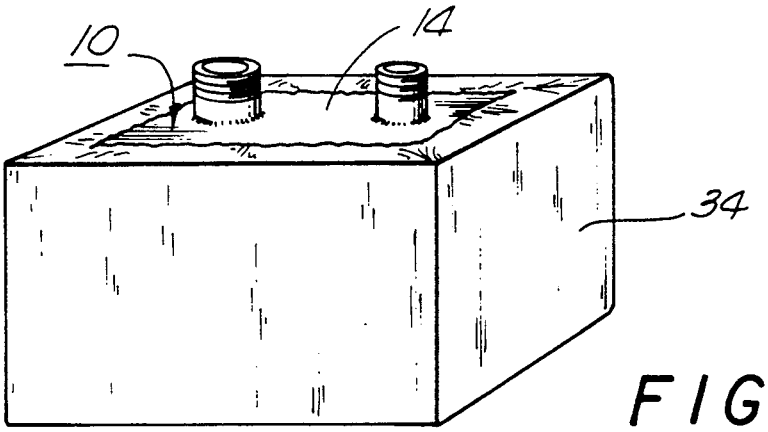
FIG. 4
FIG. 5
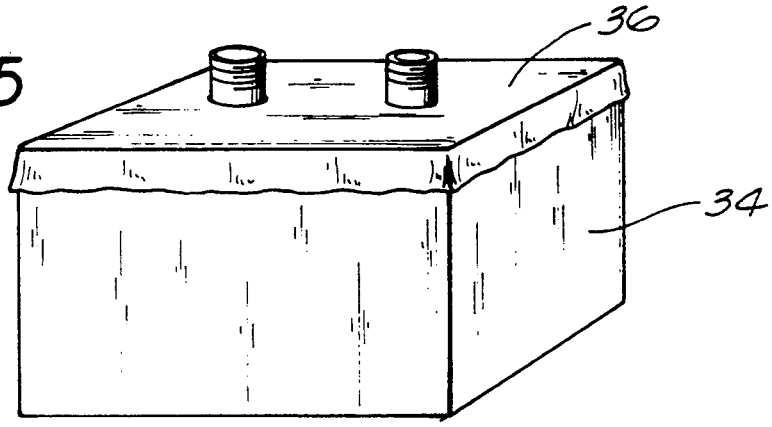
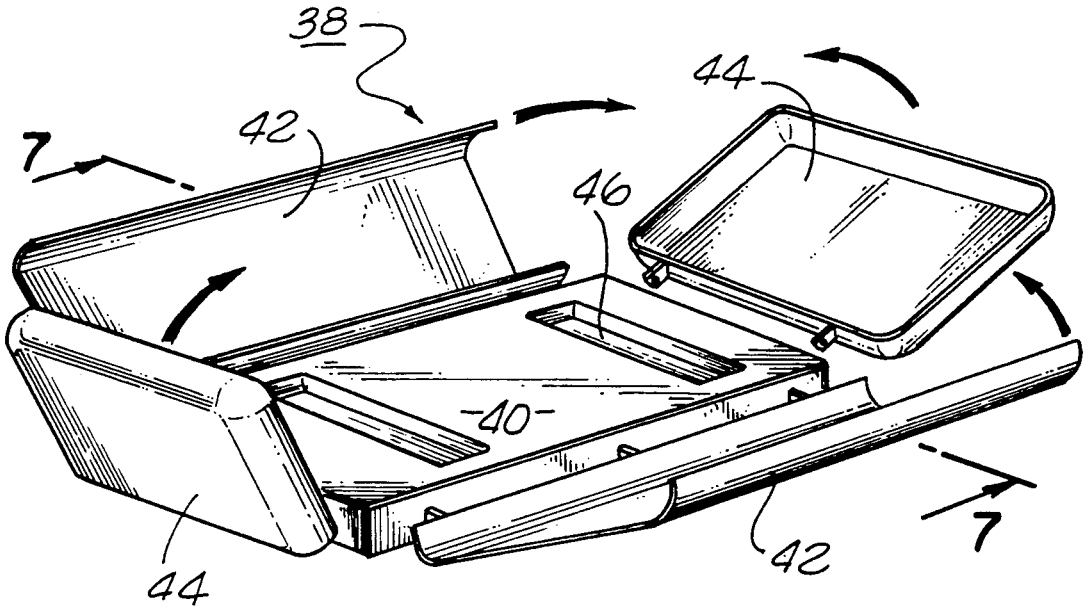
FIG. 6

FIG. 7
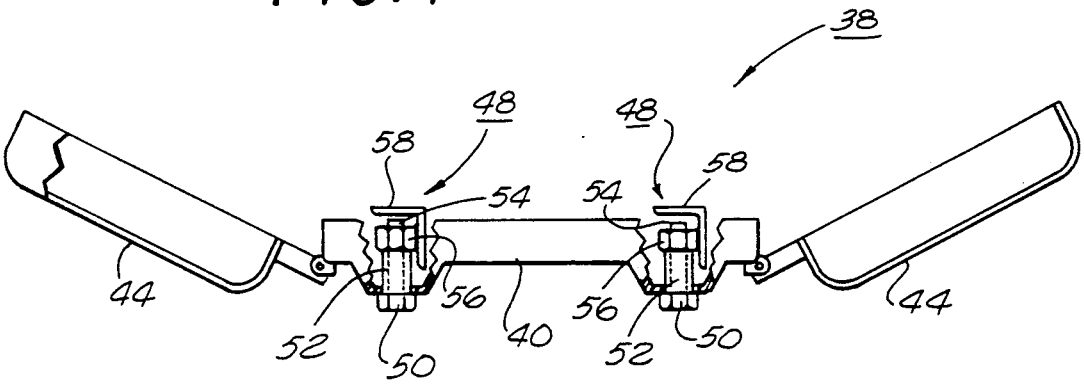
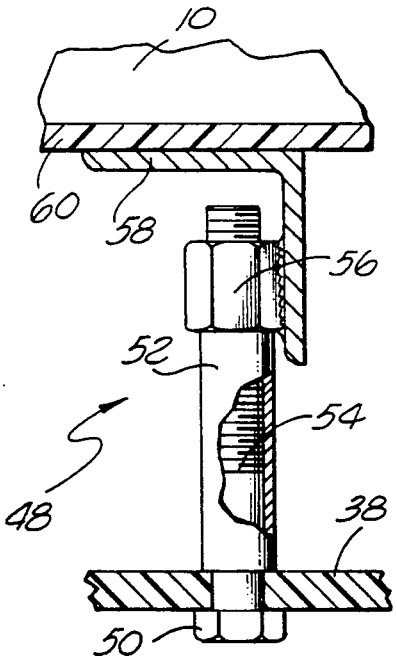
FIG. 8
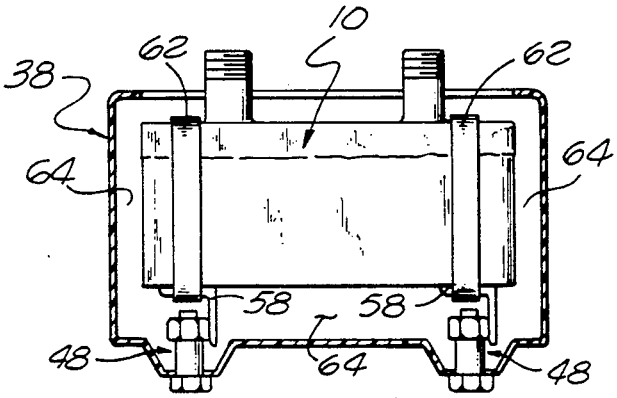
FIG. 9
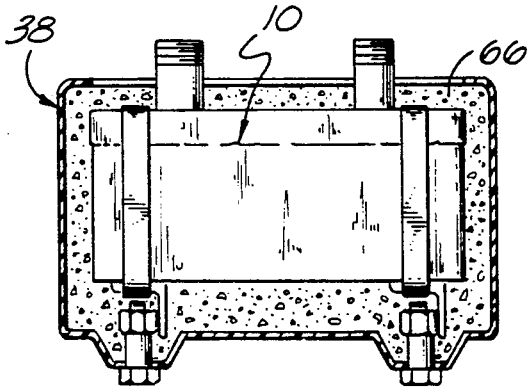
FIG. 10

METHOD FOR ENCASING A STORAGE TANK IN CONCRETE

BACKGROUND OF THE INVENTION

1. Field of the Invention

The present invention relates to above ground concrete encased storage tanks and a method for producing the same.

2. Description of Related Art

Metal storage tanks are commonly used to store flammable fluids such as jet fuel. The tanks are typically buried underground to thermally protect the fuel from fire or other combustion means. On occasion the metal containers will leak, wherein the tanks are dug up and repaired or replaced. Excavation is both time consuming and expensive, which has led to the growing use of above ground storage tanks. Above ground tanks are typically encased in concrete to protect the metal containers from fire and other damaging elements.

Manufacturing a concrete encased storage tank, also known as a storage vault, is usually performed by placing the metal container in a form and then pouring concrete around the tank. Because cement is heavier than the tank, the container tends to float upward when surrounded by the concrete. For this reason a method must be incorporated that prevents the tank from floating within the concrete. U.S. Pat. No. 4,826,644 issued to Lindquist et al, discloses a method and apparatus for encasing a storage tank in concrete. The Lindquist method includes an external support device that is placed over the top of the concrete form, wherein the device has support arms that press against the container to prevent the same from floating when concrete is poured around the tank. To encase the tank in concrete, the Lindquist method first creates a support for the tank by pouring a first layer of cement into the bottom of the form. Before the concrete has set, the tank is placed into the form and supported by the first layer of concrete. The external hold down apparatus is placed against the tank and attached to the form. A second layer of concrete is then poured in the form to completely surround the tank.

The Lindquist method is quite time consuming, wherein the support apparatus is both bulky and awkward to install and disassemble. It would be desirable to have a device that prevents the storage tank from floating in concrete that is small and simple to install.

SUMMARY OF THE INVENTION

The present invention is a method and apparatus for constructing an above ground concrete encased storage tank. The apparatus has a support assembly that extends from the baseplate of a concrete form, that supports and elevates an inner storage tank from the form baseplate, so that the tank may be completely surrounded by a single pouring of concrete. The form has walls pivotally attached to the baseplate, that are initially in a horizontal position. The support assembly has anchor bolts that extend through holes in the baseplate. The anchor bolts are screwed into anchor nuts that are attached to a pair of brackets. The anchor nuts and brackets are spaced from the baseplate by sleeves that fit over the threaded portions of the anchor bolts. The brackets are constructed to support the storage tank, which is placed in the form on top of the support assembly. Two straps are then wrapped around the tank and brackets, and fastened so that the tank is secured to the support assembly. After the tank is secured, the walls of the form are swung into a vertical position to create an enclosure with an opening at the top. Concrete is then poured into the form until the tank is completely surrounded by cement. The straps prevent the tank from floating while the concrete is still wet. The concrete is allowed to set and the anchor bolts, sleeves and form are removed from the concrete. The holes created therein are patched with concrete, wherein there is constructed an above ground storage vault.

Therefore it is an object of this invention to provide a support method and assembly that allows a storage tank to be encased with a single pouring of concrete.

It is also an object of this invention to provide a method and assembly that supports a storage tank within a mold and that prevents the storage tank from shifting or floating during the pouring of concrete, which is compact, light and simple to use.

BRIEF DESCRIPTION OF THE DRAWINGS

The objects and advantages Of the present invention will become more readily apparent to those skilled in the art after reviewing the following detailed description and accompanying drawings, wherein:

FIG. 4 is a perspective view of the storage tank of FIG. 3 covered with a liquid impervious sheet;

FIG. 5 is a perspective view of the storage tank of FIG. 4 with a plastic sheet covering the top of the tank;

FIG. 6 is a perspective view of a concrete mold for the storage tank; o FIG. 7 is a side view similar to FIG. 6 showing a support assembly installed into the concrete mold;

FIG. 8 is an enlarged view of a support assembly attached to the storage tank;

FIG. 9 is a side view of a storage tank attached to the support assembly by a pair of straps;

FIG. 10 is a side view similar to FIG. 9 showing concrete poured into the cavity between the storage tank and mold;

DETAILED DESCRIPTION OF THE INVENTION

Figure 1:
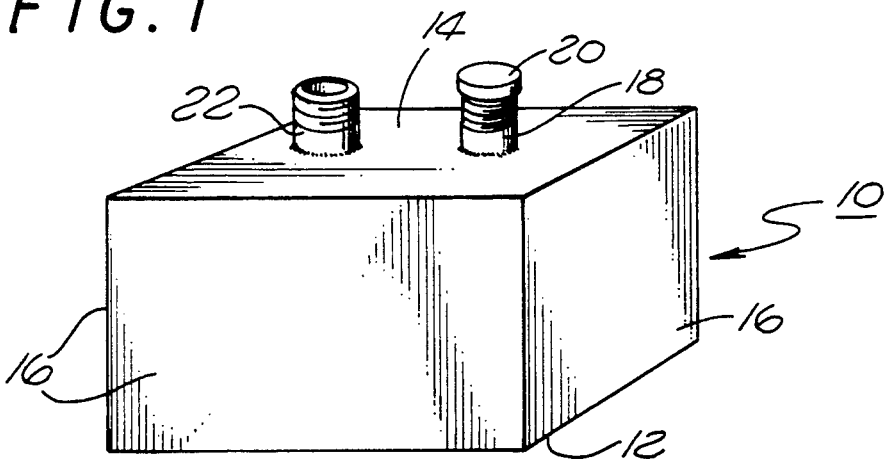
FIG. 1 is a perspective view of a storage tank.

Referring to the drawings more particularly by reference numbers, FIG. 1 shows a storage tank 10 of the present invention. The storage tank 10 is preferably constructed from steel and is typically rectangular in shape, although other shapes (cylindrical etc.) can be used. The tank 10 has an inner cavity that can contain and store a fluid or other storable material. A common use for the tank is the storage of a petroleum based fluid such as jet fuel. The rectangular container 10 has a bottom wall 12, a top wall 14 and four adjacent side walls 16. Typical dimensions for such rectangular steel tanks range from 24 inches by 34 inches by 36 inches for a 125 gallon capacity container, to 48 inches by 82 inches by 120 inches for a 2000 gallon capacity container. It being understood that the present invention includes tanks that are smaller or larger than the examples provided.

Figure 2:
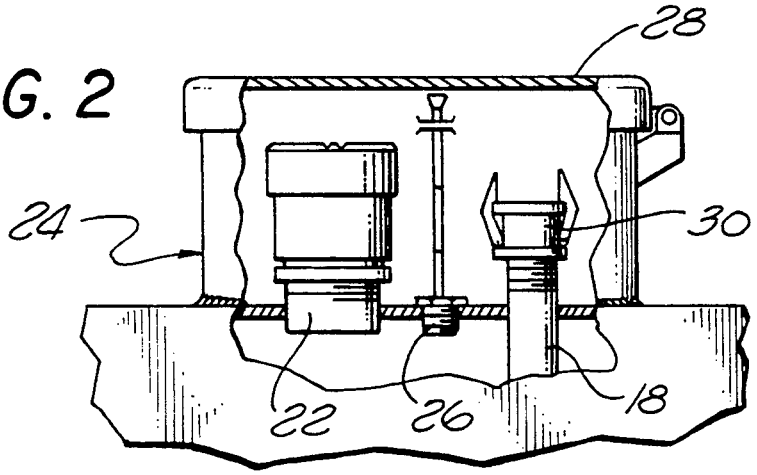
FIG. 2 is a cross-sectional side view of a reservoir attached to the fill pipe of the storage tank shown in FIG. 1.

Within the top wall 14 is an inlet pipe 18 that allows the fluid to flow into the tank 10. The inlet pipe 18 may have a cap 20 to prevent contamination of the inner cavity of the tank 10. A vent pipe 22 may be attached to the top wall 14 which has a pressure relief valve incorporated therein, that allows gaseous vapors to flow out of the tank when the gas pressure within the inner cavity reaches a predetermined level. The vent pipe 22 allows gas to bleed off in the event the fuel within the tank increases in temperature, providing a safety feature that is typically found in such tanks. As shown in FIG. 2, a reservoir 24 may be attached to the inlet pipe 18 to catch any fluid that may spill during the filling or removal of fuel into the tank. The reservoir 24 may have a drain 26 that when lifted, allows the spilled fluid to flow into the inner cavity). A lid 28 may be pivotally connected to the reservoir 24 to conceal the inlet pipe 18 when the pipe is not being used. The inlet pipe 18 may have a quick disconnect 30 so that a fuel hose can be rapidly connected and detached from the tank. The vapor return pipe 22 may be located within the reservoir 24 as shown in FIG. 2. The tank 10 may have additional pipes to provide a pump outlet, fuel return, normal venting, gauging, inventory control, leak detection and a vapor return.

Figure 3:
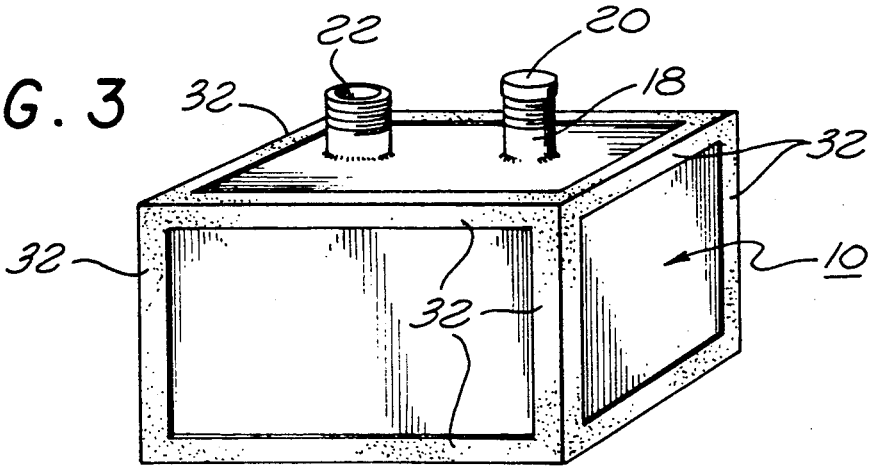
FIG. 3 is a perspective view of the storage tank of FIG. 1 with the edges of the tank covered with a foam material.

The tank 10 may be initially pressure tested for leaks and then painted. In the preferred embodiment, all of the corners and edges of the tank are then covered with a foam material 32, as shown in FIG. 3. The foam material is preferably a 4 inch wide, ⅛ inch thick sheet of polyethylene that is cut into strips and folded around the edges of the tank 10. As shown in FIG. 4, the tank is then placed on a flexible liquid impervious sheet 34 that is folded up and attached to the top wall 14. The sheet 34 provides a liquid barrier, so that any fluid which leaks from the tank 10 will not escape and contaminate the environment. The sheet 34 is preferably constructed from a high density polyethylene approximately 0.030 inches thick. The foam material 32 prevents the edges of the tank 10 from tearing or puncturing the sheet 34, to insure a liquid tight containment. As shown in FIG. 5, another flexible sheet 36 may be placed over the top surface 14 of the tank and attached to the liquid impervious sheet 34 along the sides of the container 10. Holes are cut into the sheet 36 to allow the pipes 20 and 22 to extend through the sheet 36. The second sheet 36 is preferably constructed from a low density polyethylene approximately 0.006 inches thick. The second sheet 36 is attached primarily to prevent concrete or other foreign matter from falling between the sheet 34 and the tank 10.

FIG. 6 shows a concrete form 38 that has a baseplate 40, along with two sidewalls 42 and two end walls 44 pivotally connected to the baseplate 40. Although the walls are shown and described as being hinged to the baseplate, it is to be understood that the form 38 could be adapted to have walls that are attached and removed from the baseplate. The walls 42 and 44, can be swung into a vertical position to create an enclosure. The baseplate 40 may have a pair of feet cavities 46 that create skids in the resulting concrete encased storage vault. The walls ,2 of the form 38 are initially in a horizontal position as shown. The form is typically cleaned and then sprayed with a mold release before each usage. As shown in FIG. 7, a support assembly 48 is then fastened to the baseplate 40 of the form 38.

Figure 7A:
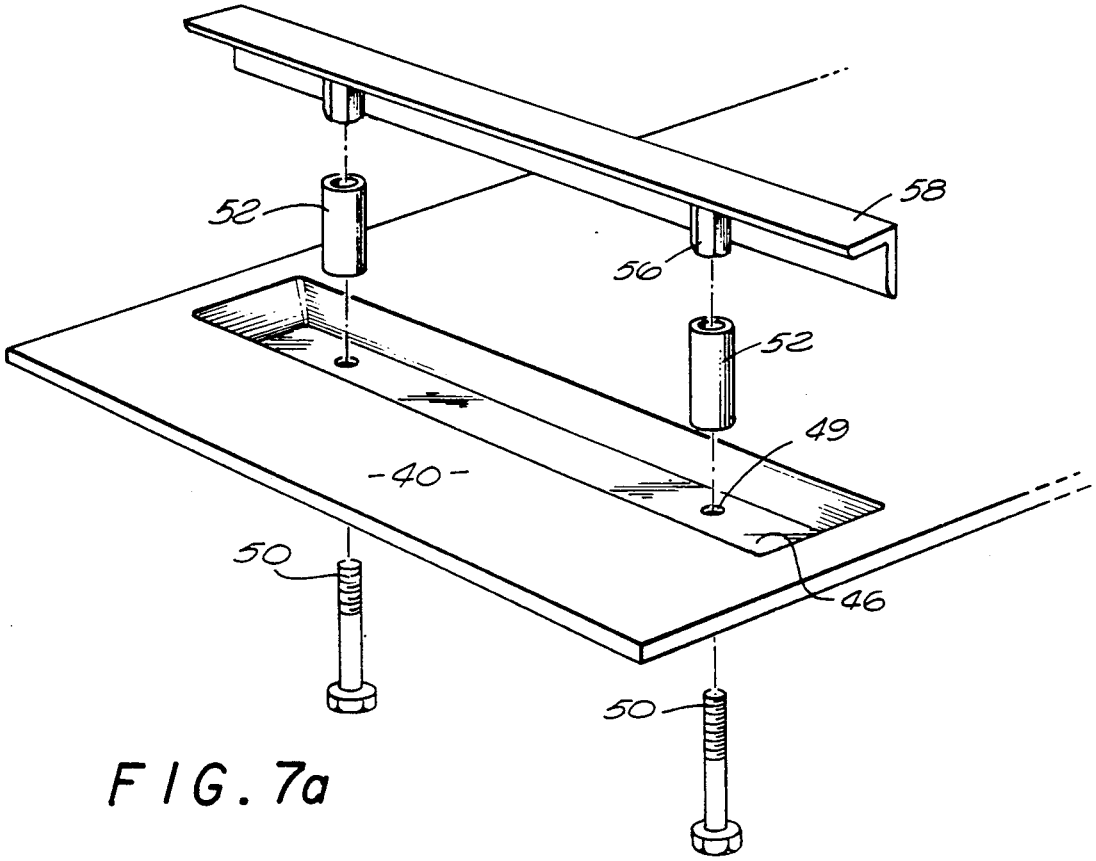
FIG. 7*a* is a perspective view showing the partial assembly of a support assembly.

As shown in FIG. 7*a*, the assembly 48 is installed by first placing sleeves 52 in the feet cavities 46 on top of the holes 49 in the baseplate 40. There are typically four sleeves 52 in the assembly 48. Although more sleeves 52 may be required for large tanks. Angle brackets 58 are placed on top of the sleeves 52, and bolts 50 are then inserted into the baseplate holes 49 and through the sleeves 52. The length of the sleeve 52 is less than the threaded shank 54, so that the bolt 50 can be screwed into anchor nuts 56 that are welded to the support angle 58, as more clearly shown in FIG. 8. The bolts 50 are tightened so that the support angles 58 are securely fastened to the mold 38. The sleeves 52 have an inside diameter that is larger than the diameter of the holes in the baseplate 40, so that the support angle may be tightly clamped against the baseplate. The sleeves 52 are preferably covered with grease, so that the cement does not adhere to the sleeve 52. In the preferred embodiment, a lower assembly of steel reinforcing bars ("rebar") is placed inside the form 38. The wrapped tank 10 is then placed in the form 38 on top of the support angles 58. Padding 60 may be placed on the support angles 58, prior to tank 10 placement, so that the support angles 58 do not tear or cut the plastic sheet 34.

As shown in FIG. 9, clamping straps 62 are then wrapped around the tank 10 and support angle 58. There is typically one strap 62 for each support angle 58. The straps 62 have two ends with tensioning screws to securely clamp the tank 10 to the support angle 58 and form 38. The straps 62 are tightened so that the tank 10 is rigidly secured from movement in all directions. The straps 62 may have adjustment means as is known in the art, to compensate for different size tanks. Although an assembly 58 with two straps 62 is shown, it is to be understood that more straps 62, support angles 58 and bolts 50 can be used. For example, although it is desirable to place the support angles in the feet, it has been found that three or more supports may be preferable for tanks larger than 2000 gallons.

Figure 9A:
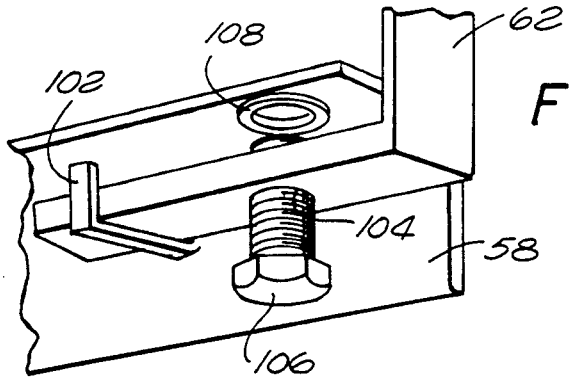
FIG. 9*a* is a perspective view showing the attachment of the support assembly strap to an support angle.
Figure 9B:
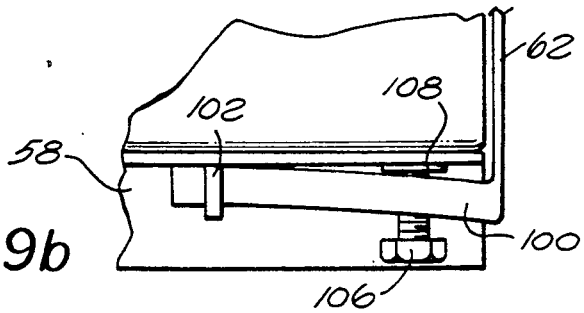
FIG. 9*b* is a side view showing the strap of FIG. 9*a* secured to the support angle.

FIGS. 9*a* and 9*b* show a preferred embodiment of attaching the straps 62 to the support angle 58 and securing the support angles 58 to the tank 10. The straps 62 are preferably constructed from steel approximately 0.25 inches thick. The metal straps 62 are formed to fit over the tank and under the support angles 58. Each strap 62 has a pair of ends 100 that are each inserted through a corresponding retraining bracket 102 extending from the support angle 58. The strap ends 100 have threaded holes 104 that receive bolts 106 which are screwed into the straps 62. The strap 62 is adjusted so that the bolt 106 is aligned with a washer 108 that is attached to the underside cf the support angle 58. The bolt 106 is screwed until the end of the bolt 106 is captured by the washer 108. The support angle 58 prevents any further movement of the bolt 106, such that further rotation of the bolt 106 pulls the strap end 100 away from the support angle 58 and tightens the strap 62 around the tank 10, thereby securing the tank 10 to the support angle 58 and form 38. The retaining bracket 102 secures the very end of the strap 62, such that the strap end 100 is cantilevered about the retaining bracket 58. This insures that the sides of the strap 62 are tensioned instead of merely bending the strap end 100, which would occur if the end of the strap was not secured. The washer 108 prevents any lateral movement of the bolt 106 relative to the support angle 58. This insures that the tank 10 will not laterally shift within the form 38 when concrete is poured around the tank 10. The washer 108 provides a simple inexpensive means of laterally restraining the strap 62 and tank 10 while allowing the bolt 106 to rotate within the washer 108.

Figure 11:
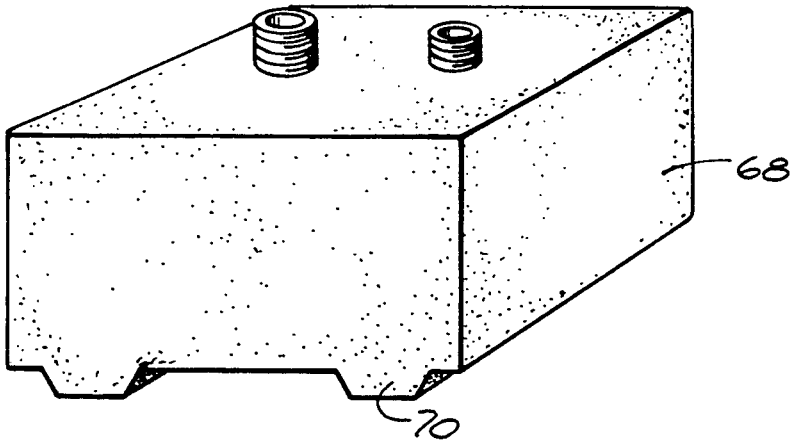
FIG. 11 is a perspective view of a concrete encased storage tank of the present invention.

After the tank 10 is securely fastened to the form 38, a top assembly of rebar (not shown) can be placed in the form 38 around the tank 10. The top and bottom assemblies of rebar, provide structural support for the hardened concrete wall that will surround the tank 10 and are required to meet fire resistive construction standards. When the top assembly of rebar is in place, the walls 42, 44 of the form 38 are swung into the vertical position to create a cavity 64 around the tank 10. The sleeves 52 provide support for the tank to hold it above the bottom of the form, a distance equal to the space between the tank and the sidewalls of the form to allow a uniform thickness of concrete encasement around the tank. pressurized with air, preferably between 1–3 psi. The air pressure should preferably be enough to offset the average pressure of the concrete around the tank to stabilize the steel tank walls against the external pressure. In the preferred embodiment, a fixture is attached to the pipes at the top of the tank to keep the pipes straight while the concrete is poured and setting. After the tank is pressurized, unset concrete is poured into the cavity until the tank is completely surrounded by concrete, as shown in FIG. 10. A vibrator can be inserted into the unset concrete to help consolidate the concrete as is well known in the art. In addition, external vibrators may be mounted on the forms to aid the proper placement and consolidation of the concrete. The tank 10 and form 38 are left undisturbed until the concrete sets, whereupon the walls 42, 44 of the form 38 are removed or swung into the horizontal position. The bolts 50 are removed from the set concrete and form, which allows the concrete encased tank to be separated from the form. The pipe fixtures are removed, whereby there is constructed a concrete encased storage vault 68, as shown in FIG. 11. Once the tank has been removed, the spacer sleeves may be removed from the concrete. The application of grease to the spacer sleeves not only prevents the concrete from adhering, but aids in the removal of the sleeves 52 from the concrete wall. The holes created by the removal of the sleeves 52 may be filled with concrete to completely enclose the tank 10.

The feet cavities 46 create integrally formed feet 70 in the vault 68 that elevate the tank above the ground. The feet 70 and accompanying space under the tank, provide easy mobility and access to the bottom of the vault 68, to aid in the detection of leaks within the tank 10. Although the concrete encased storage vault 68 is typically used above ground, the vault of the present invention could be installed underground.

Figure 12:
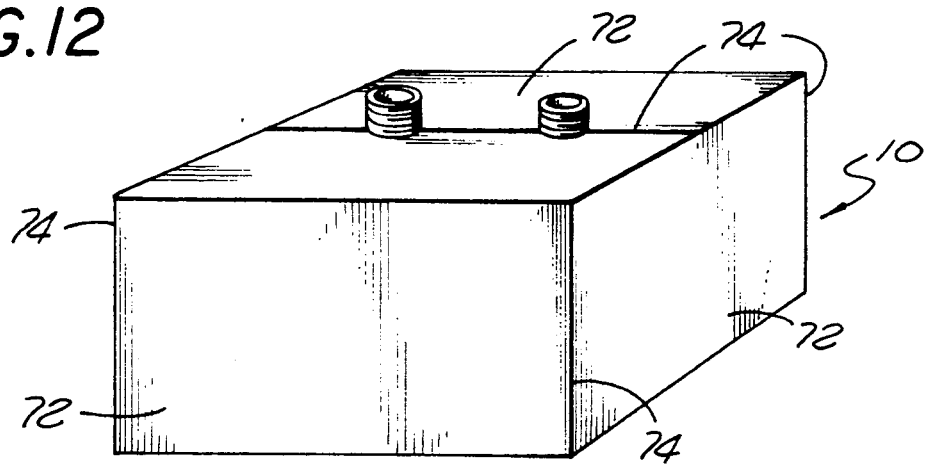
FIG. 12 is a perspective view of a storage tank enclosed by sheets of metal.
Figure 13:
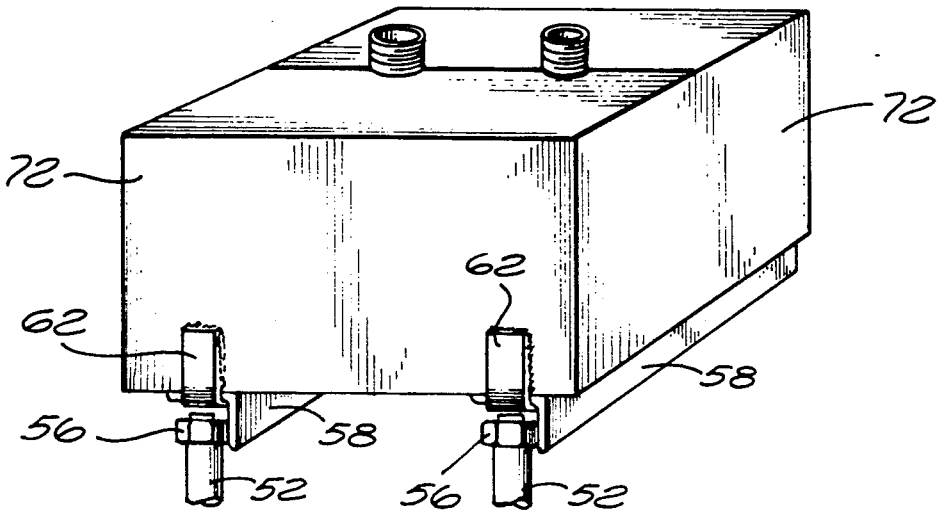
FIG. 13 is a perspective view of the storage tank of FIG. 12 mounted to a support assembly.

FIG. 12 shows another embodiment of the tank 10. Sheets 72 of metal, preferably 12 gauge steel, are bent around the tank to encapsulate the same. The sheets 72 have holes or slots to allow the pipes to extend through the steel, wherein the sheets 72 are welded 74 to each other and the pipes, to enclose and seal the tank 10. As shown in FIG. 13, the covered tank is then placed on top of the support angles 58, wherein straps 62' are welded to the outer steel sheets 72 and welded to the support angles to secure the tank 10 to the concrete form 38. The other steps of constructing the vault are as described above. This embodiment does not require the padding or the outer plastic layers of the previously described embodiment. The steel covered embodiment also does not require any foam padding between the support angles 58 and the tank 10.

As yet another embodiment, the anchor nuts 56 can be welded onto the steel tank 10 so that the bolts 50 can be fastened to the nuts, thereby directly attaching the tank 10 to the form 38 without having to use the straps 62 or the support brackets 58.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method of encasing a storage tank in concrete, comprising the steps of:

a) providing a form that has a baseplate and walls, said walls being adapted to be placed into a vertical position, wherein said baseplate and said walls define a cavity, said baseplate having at least four holes;

b) providing a rectangular storage tank that has top, side and bottom surfaces that are defined by edges of said storage tank, said storage tank having at least four anchor nuts extending from said bottom surface;

c) providing at least four first bolts constructed to extend through said holes of said baseplate;

d) providing at least four sleeves adapted to slide over said first bolts and to be placed onto said baseplate holes such that said sleeves extend from said baseplate into said cavity;

e) placing said sleeves onto said baseplate and over said baseplate holes;

f) placing said storage tank into said form such that said anchor nuts are positioned on said sleeves and said storage tank is supported and spaced from said baseplate by said sleeves;

g) inserting said first bolts through said baseplate holes, said sleeves and into said anchor nuts;

h) screwing said first bolts into said anchor nuts so that said storage tank is fastened to said baseplate;

i) moving said walls into said vertical position such that said storage tank is within said cavity;

j) pressurizing said storage tank with air;

k) pouring concrete into said cavity until said concrete completely surrounds said storage tank;

l) allowing said concrete to set such that there is formed a concrete encased storage tank;

m) depressurizing said storage tank;

n) removing said first bolts from said form;

o) removing said form from said concrete encased storage tank;

p) removing said sleeves from said concrete encased storage tank, wherein there is created at least four holes in said concrete; and, q) placing concrete into said holes.

2. A method of encasing a storage tank in concrete comprising the steps of:

a) providing a form that has a baseplate and walls, said walls being adapted to be placed into a vertical position, wherein said baseplate and said walls define a cavity, said baseplate having at least four holes;

b) providing a storage tank;

c) providing elevation means attached to said baseplate for supporting and elevating said storage tank from said baseplate, said elevation means being adapted to be attached to said baseplate and said storage tank, wherein said elevation means includes at least four first bolts that extend through said four holes in said baseplate into said cavity, said four first bolts being attachable to four anchor nuts that are spaced from said baseplate by four spacer sleeves placed over said first bolts and said four holes, said anchor nuts being attached to at least one bracket adapted to support said storage tank;

d) attaching said elevation means to said baseplate of said form by placing said four first bolts through said holes in said baseplate and through said spacer sleeves placed over said four holes and securing said four first bolts to said four anchor nuts;

e) placing said storage tank in said form such that said storage tank is supported by said bracket of said elevation means, wherein said storage tank is elevated from said baseplate by said spacer sleeves such that there is a space between said storage tank and said baseplate;

f) attaching said storage tank to said bracket by at least two straps that extend around said storage tank and said bracket to secure said storage tank to said bracket;

g) moving said walls into said vertical position such that said storage tank is within said cavity;

h) pouring concrete into said cavity until said concrete completely surrounds said storage tank;

i) allowing said concrete to set such that there is formed a concrete encased storage tank; and, j) removing said form from said concrete encased storage tank.

3. The method as recited in claim 2, further comprising the steps of providing at least four second bolts that extend through threaded holes in said straps such that said second bolts engage said bracket and tighten said straps around said storage tank to secure said storage tank to said bracket, said bracket having a retaining bracket that secures said straps such that said straps are pulled away from said bracket when said second bolts are tightened onto said bracket.

4. The method as recited in claim 3, wherein said bracket has at least four washers that capture said second bolts and prevent lateral movement of said storage tank within said form.

5. The method as recited in claim 2, further comprising the steps of removing said bolts and said sleeves after said concrete has set, wherein said bolts are removed before said form is removed from said concrete encased storage tank and said sleeves are removed after said form is removed from said concrete encased storage tank, and wherein said removal of said bolts and said sleeves creates at least four holes in said concrete encased storage tank.

6. The method as recited in claim 5, further comprising the step of filling said holes with concrete.

7. The method as recited in claim 5, wherein said sleeves are covered with a releasing agent which allows said sleeves to be easily removed from said set concrete.

8. The method as recited in claim 1, further comprising the step of placing a padding material between said storage tank and said bracket before said storage tank is placed onto said bracket.

9. The method as recited in claim 2, wherein said provided storage tank is wrapped with a liquid impervious sheet such that said liquid impervious sheet contains any liquid that escapes from said storage tank.

10. The method as recited in claim 9, wherein said liquid impervious sheet is constructed form polyethylene.

11. The method as recited in claim 10, wherein said provided storage tank has edges and a plurality of padding strips attached to said edges to prevent said storage tank from penetrating said liquid impervious sheet.

12. The method as recited in claim 9, wherein said liquid impervious sheet is constructed from steel.

13. The method as recited in claim 2, further comprising the steps of pressurizing said storage tank before said concrete is poured into said cavity and depressurizing said storage tank after said concrete has set.

14. The method as recited in claim 13, wherein said tank is pressurized with air between 1 and 3 psi.

15. The method as recited in claim 2, further comprising the steps of placing a bottom assembly of reinforcing bars in said form before said storage tank is placed in said form, and placing a top assembly of reinforcing bars in said form after said storage tank is placed in said form.

16. The method as recited in claim 2, wherein said provided storage tank has an inlet pipe adapted to allow fluid to flow into said storage tank, said inlet pipe further having a reservoir adapted to contain fluid that is introduced to an external portion cf said storage tank adjacent to said inlet pipe.

17. A method of encasing a storage tank in concrete, comprising the steps of:

a) providing a form that has a baseplate and walls, said walls being adapted to be placed into a vertical position, wherein said baseplate and said walls define a cavity, said baseplate having at least four holes;

b) providing a storage tank;

c) providing at least four first bolts constructed to extend through said holes of said baseplate;

d) providing at least one bracket with at least four anchor nuts adapted to receive said four first bolts, said bracket being constructed to support said storage tank, said bracket having at least four retaining brackets;

e) providing a plurality of sleeves adapted to slide over said first bolts and to be placed onto said baseplate such that said sleeves extend from said baseplate into said cavity;

f) providing at least two straps that extend around said storage tank, each strap having two ends and a threaded hole at each said end, said strap ends being adapted to be inserted into said retaining brackets;

g) providing at least four second bolts that are screwed into said strap holes and engage said bracket;

h) providing at least four washers attached to said bracket and adapted to capture said second bolts to prevent lateral movement of said second bolts relative to said bracket;

i) placing said sleeves onto said baseplate and over said baseplate holes;

j) placing said anchor nuts onto said sleeves such that said bracket is supported and spaced from said baseplate by said sleeves;

k) inserting said first bolts through said baseplate holes;

l) screwing said first bolts into said anchor nuts so that said bracket is fastened to said baseplate;

m) placing said storage tank in said form on top of said bracket such that said storage tank is supported by said bracket, wherein said storage tank is elevated from said baseplate such that there is a space between said storage tank and said baseplate;

n) wrapping said straps around said storage tank and said bracket, such that said strap ends are inserted into said bracket;

o) screwing said second bolts into said straps such that said straps are secured to said bracket and said second bolts are captured by said washers;

p) moving said walls into said vertical position such that said storage tank is within said cavity;

q) pouring concrete into said cavity until said concrete completely surrounds said storage tank;

r) allowing said concrete to set such that there is formed a concrete encased storage tank;

s) removing said first bolts from said form;

t) removing said form from said concrete encased storage tank;

u) removing said sleeves from said concrete encased storage tank, wherein there are created at least four holes in said concrete; and, v) placing concrete into said holes in said concrete.

18. The method as recited in claim 17, wherein there are provided two brackets each attached to a pair of anchor nuts, each bracket being attached to said baseplate by a pair of bolts.

19. The method as recited in claim 18, wherein there are provided two straps that are wrapped around said storage tank and a corresponding bracket.

20. The method as recited in claim 17, wherein there are provided three brackets each attached to a pair of anchor nuts, each bracket being attached to said baseplate by a pair of bolts.

21. The method as recited in claim 20, wherein there are provided three straps that are wrapped around said storage tank and a corresponding bracket.

22. The method as recited in claim 17, wherein said sleeves are covered with a releasing agent to allow said sleeves to be easily removed from said set concrete.

23. The method as recited in claim 17, further comprising the step of placing padding between said storage tank and said bracket before said storage tank is placed onto said bracket.

24. The method as recited in claim 19, wherein said provided storage tank is wrapped with a liquid impervious sheet in such a manner that said liquid impervious sheet contains any liquid that escapes from said storage tank.

25. The method as recited in claim 24, wherein said liquid impervious sheet is constructed from polyethylene.

26. The method as recited in claim 25, wherein said provided storage tank has edges and a plurality of padding strips attached to said edges to prevent said storage tank from penetrating said liquid impervious sheet.

27. The method as recited in claim 24, wherein said liquid impervious sheet is constructed from steel.

28. The method as recited in claim 17, further comprising the steps of pressurizing said storage tank before said concrete is poured into said cavity and depressurizing said storage tank after said concrete has set.

29. The method as recited in claim 28, wherein said tank is pressurized with air between 1 and 3 psi.

30. The method as recited in claim 17, further comprising the steps of placing a bottom assembly of reinforcing bars in said form before said storage tank is placed in said form, and placing a top assembly of reinforcing bars in said form after said storage tank is placed in said form.

31. The method as recited in claim 17 wherein said provided storage tank has an inlet pipe adapted to allow fluid to flow into said storage tank, said inlet pipe further having a reservoir adapted to contain fluid that is introduced to an external portion of said storage tank adjacent to said inlet pipe.

32. A method of encasing a storage tank in concrete comprising the steps of:

a) providing a form that has a baseplate and walls, said walls being adapted be placed into a vertical position, wherein said baseplate and said walls define a cavity, said baseplate having at least four holes;

b) providing a rectangular storage tank that has top, side and bottom surfaces that are defined by edges of said storage tank, said bottom and said side surfaces being covered by a liquid impervious sheet;

c) providing at least four first bolts constructed to extend through said holes of said baseplate;

d) providing at least two brackets each with two anchor nuts adapted to receive said first bolts, said brackets being constructed to support said storage tank, each said bracket having two retaining brackets;

e) providing at least four sleeves adapted to slide over said first four bolts and to be placed onto said baseplate holes such that said sleeves extend from said baseplate into said cavity;

f) providing two straps that extend around said storage tank, each strap having two ends and a threaded hole at each said end, said strap ends being adapted to be inserted into said retaining brackets;

g) providing at least four second bolts that are screwed into said strap holes and engage said brackets;

h) providing at least four washers attached to said brackets and adapted to capture said second bolts to prevent lateral movement of said second bolts relative to said brackets;

i) placing said sleeves onto said baseplate and over said baseplate holes;

j) placing said anchor nuts onto said sleeves such that said brackets are supported and spaced from said baseplate by said sleeves;

k) inserting said first bolts through said baseplate holes, said sleeves and into said anchor nuts;

l) screwing said first bolts into said anchor nuts so that said brackets are fastened to said baseplate;

m) placing said storage tank in said form on top of said brackets such that said storage tank is supported by said brackets, wherein said storage tank is elevated from said baseplate such that there is a space between said baseplate and said storage tank;

n) wrapping said straps around said storage tank and said brackets, such that said strap ends are inserted into said retaining brackets;

o) screwing said second bolts into said straps such that said straps are secured to said brackets and said second bolts are captured by said washers;

p) moving said walls into said vertical position such that said storage tank is within said cavity;

q) pressurizing said storage tank with air;

r) pouring concrete into said cavity until said concrete completely surrounds said storage tank;

s) allowing said concrete to set such that there is formed a concrete encased storage tank;

t) depressurizing said storage tank;

u) removing said first bolts from said form;

v) removing said form from said concrete encased storage tank;

w) removing said sleeves from said concrete encased storage tank, wherein there is created at least four holes in said concrete; and, x) placing concrete into said holes.

33. The method as recited in claim 32, wherein said tank is pressurized with air between 1 and 3 psi.

34. The method as recited in claim 33, further comprising the steps of placing a bottom assembly of reinforcing bars in said form before said storage tank is placed in said form, and placing a top assembly of reinforcing bars in said form after said storage tank is placed in said form.

35. The method as recited in claim 33, wherein said liquid impervious sheet is constructed from steel.

36. The method as recited in claim 33, wherein said liquid impervious sheet is construed from polyethylene.

37. The method as recited in claim 36, wherein said provided storage tank has a plurality of padding strips attached to said edges of said storage tank, said padding strips preventing said storage tank from penetrating said liquid impervious sheet.

38. The method as recited in claim 37, further comprising the step of placing padding between said storage tank and said brackets before said storage tank is placed onto said brackets.

39. The method as recited in claim 38, wherein said provided storage tank has a flexible sheet wrapped around said top surface of said storage tank and attached to said liquid impervious sheet along said side surfaces.

40. The method as recited in claim 32, wherein said sleeves are covered with a releasing agent to allow said sleeves to be easily removed from said set concrete.

41. The method as recited in claim 32, wherein said provided storage tank has an inlet pipe adapted to allow fluid to flow into said storage tank, said inlet pipe further having a reservoir adapted to contain fluid that is introduced to an external portion of said storage tank adjacent to said inlet pipe.

* * * * *